US005466027A

United States Patent [19]

Hockey

[11] Patent Number: 5,466,027

[45] Date of Patent: Nov. 14, 1995

[54] BALL RETRIEVING AND STORAGE DEVICE

[76] Inventor: Edward J. Hockey, 4513 Cove Dr., #9, Carlsbad, Calif. 92008

[21] Appl. No.: 428,333

[22] Filed: Apr. 25, 1995

[51] Int. Cl.[6] ..... A63B 47/02

[52] U.S. Cl. ..... 294/19.2

[58] Field of Search ..... 294/19.2, 99.1, 294/102.1; 56/328.1; 81/53.11; 221/307, 310; 224/919; 273/32 D

[56] References Cited

U.S. PATENT DOCUMENTS

| | | | |
|---|---|---|---|
| 2,706,657 | 4/1955 | Talley | 294/19.2 |
| 2,760,807 | 8/1956 | Watson | 294/19.2 |
| 2,810,252 | 10/1957 | Kelly | 294/19.2 X |
| 4,063,769 | 12/1977 | Zimmer | 294/19.2 |
| 4,678,108 | 7/1987 | Inman | 294/19.2 X |
| 5,037,150 | 8/1991 | Vecchi | 294/19.2 |
| 5,060,996 | 10/1991 | Garnes | 294/19.2 |

*Primary Examiner*—Johnny D. Cherry
*Attorney, Agent, or Firm*—John J. Murphey; Murphey Law Offices

[57] ABSTRACT

A ball retrieving storage device including an elongated hollow tube opened at one end for reception of a ball, the tube having formed in the opened end a circumferential groove concentrically arranged therewith opening inwardly toward the hollow interior of the tube and defined by upper and lower groove side surfaces, a yieldable ring of measured thickness concentrically located in the groove, the ring having an internal diameter slightly smaller than the outside diameter of the ball to be retrieved, wherein the groove is wider than the thickness of the ring to allow the ring to be moveable therein and displacable upward therein in response to the upward pressure of a to-be-retrieved ball from below when the opened end of the tube is passed over the ball, and wherein the groove has a first depth, in the area of natural repose of the ring, and a second depth in the area of the upward displacement thereof, wherein the second depth is greater than the first depth to allow the ring to expand under the upward pressure of the ball and allow passage of the ball therethrough into storage in the tube and to prevent the ring from thereafter expanding under downward pressure of the ball and bar retractive passage of the ball out through the tube opened end.

20 Claims, 1 Drawing Sheet

BALL RETRIEVING AND STORAGE DEVICE

BACKGROUND OF THE INVENTION

1. Field of the Invention

This invention pertains to the field of sports accessories such as golf accessories. More particularly, this invention pertains to a device for retrieving and storing balls, such as golf balls, where the retrieval mechanism is designed to prevent damage to the finish on the ball.

2. Description of the Prior Art

Certain sports, such as golf, have become a sophisticated pastime. Where, in the past, the links were often occupied by gangly teenagers hacking at golf balls with a wooden-shaft niblick or mashie, the sport enjoys modern refinement, shared by adult men and women, who use state-of-the-art metal or composite-shafted golf clubs of varying design to hit high-tech golf balls, having shiny, modern surfaces, often carrying the name or initials of their owner.

To stay in practice, the sport has developed the art of "shagging", which is where the golfer places a plurality of golf balls, such as 25, in a small area then begins to hit them, one at a time, using one or more golf clubs. A person can practice their driving, mid-fairway shots, chipping and putting in this manner. The balls are retrieved by either bending over and picking them up one-at-a-time or by using a ball retainer to capture them. Holding 25 golf balls is extremely difficult and accordingly most golfers try to use a golf ball retrieving device. These retrieving devices also often double as a storage compartment for the balls when the retrieving device is placed in the golf bag and carried along with the clubs until the next shagging practice takes place.

A number of problems arise with prior art ball retrieving devices and/or ball retrieving and storage devices. Modern golf balls have exceedingly accurate sphericity and the surface thereof is treated to have a smooth albeit dimpled, but shiny surface to reduce air resistance during flight. The golf club head is designed to strike the golf ball flush so as generally not to pose a danger to the finish on the ball. However, many prior art golf ball retrieving devices contain elements that contact the balls' surface and cause indentations, scratches and scuffing of the surface. These deleterious effects cause the ball to lose accuracy and range.

A number of prior art golf ball retrieving devices call for the balls to be retrieved and stored in a tubular magazine. The device is usually operated by placing the tube vertically over the ball to be retrieved and pressing the tube downward causing upward pressure on the ball and forcing it into the tube. As other balls are retrieved, those in the tube are forced upward toward the top of the tube. After an inventory of balls is developed in the tube, the combined weight of them causes downward pressure on the bottom-most ball in the tube, adjacent the intake element at the bottom thereof. A significant problem has developed in that this pressure forces the bottom-most ball out of the bottom of the tube through the intake mechanism and causes more scuffing to the surface thereof. Even more significant is the fact that during transit, such as in the trunk of a car or in an airplane, those balls escape through the bottom of the storage device and wind up in the bottom of the golf bag. To retrieve these balls, one must empty the golf bag of clubs and turn the golf bag upside down. Often the balls that spill out of the bag do so in an uncontrolled manner and are lost or become a hazard to others nearby.

SUMMARY OF THE INVENTION

This invention is a unique design of a tubular golf ball retrieving and storage device that allows passage of a ball into the bottom thereof without any scuffing or other damage being caused to the surface or finish of the ball. Even more unique is the mechanism of this invention operating to prevent escape of any ball from the interior thereof through the bottom opening notwithstanding the pressure of the balls in the tubular container as well as finger or other pressure applied to the top ball. The novelty of this invention resides in the fact that downward pressure against the bottom ball is vectored through the mechanism into the tubular wall under circumstances that prevent any slippage whatsoever between the bottom ball and the retrieval mechanism so as to prevent any movement under pressure thus preventing scuffing or other damage to the surface or finish of the ball.

The invention comprises an elongated tube opened at the bottom end for reception of a golf ball. A circumferential groove is concentrically arranged near the bottom of the tube with a yieldable ring concentrically located in the groove where the ring has an internal diameter slightly smaller than the outside diameter of the ball. The groove is wider than the thickness of the ring to allow the ring to be displaced upward in response to the upward pressure of a to-be-retrieved ball when the opened end of the tube is passed over the ball. The groove has a first depth in the area of natural repose of the ring and a second depth in the area of the upward displacement thereof where the second depth is greater than the first depth to allow the ring to expand under the upward pressure of the ball and allow passage through the ring into storage in the tube and to prevent the ring from expanding under downward pressure and bar retractive passage of the ball out through the tube opened end. This phenomenon is developed by slanting the bottom surface of the groove from the lesser depth to the greater depth so that downward pressure from the ball against the ring vectors the force from the ball across the ring and into the slanted groove surface and thence in the wall of the tube.

Accordingly, the main object of this invention is a ball retrieving and storage device that does not score or otherwise damage the surface of the balls retrieved and stored therein. Other objects of the invention include a device that is unaffected by downward pressure on the balls retained or stored in the tube and that prevents any retractive movement of the ball therein; a device that allows one to visualize the number of stored balls in the tube; a device that allows balls to be loaded into a golf bag along with the clubs to store the balls therein; a device that is simple in manufacture and thus carries a retail price well within the financial abilities of most adults; a device that is easy to use, durable, safe and lightweight.

These and other objects of the invention may be determined by reading the following description of the preferred embodiment taken together with the drawings appended hereto. The scope of protection sought by the inventor herein may be gleaned from a fair reading of the claims which conclude this specification.

DESCRIPTION OF THE PREFERRED EMBODIMENT

Figure 1:
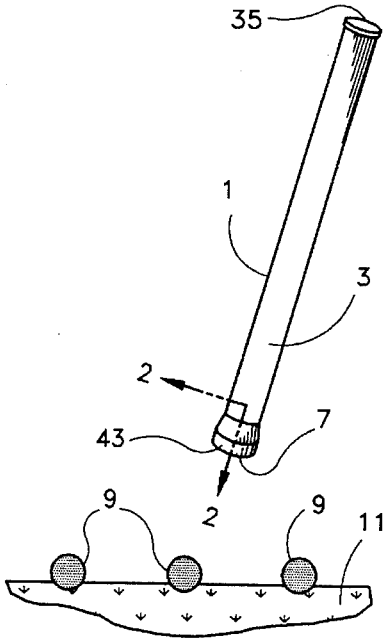
FIG. 1 is an illustrative view of the overall design of the preferred embodiment of this invention positioned for utilization over a plurality of golf balls.

Turning now to the drawings wherein like elements are identified with like numerals throughout the six figures, the ball retrieving and storage device 1 is shown in FIG. 1 to comprise an elongated hollow tube 3 having a sturdy tubular wall 5 sufficient for self-support, opened at a lower distal end 7 for reception of one or more balls 9 that generally lie on the ground 11 either before or during a shagging practice. In practice, tube 3 is held vertically by the user's hand and positioned over a ball 9 and then pressed downward to force the ball upward into the open end of tube 3.

Tube 3 is preferably cylindrical and straight in overall shape having an inside diameter slightly larger than the outside diameter of the balls to be retrieved and stored therein. While this description is centered about the retrieval of golf balls, it should be kept in mind that this inventive device is useful to retrieve other types of balls such as tennis balls, croquet balls, boccie balls and the like. The inventor does not intend to limit himself to retrieving any one specie of balls with this invention.

Figure 6:
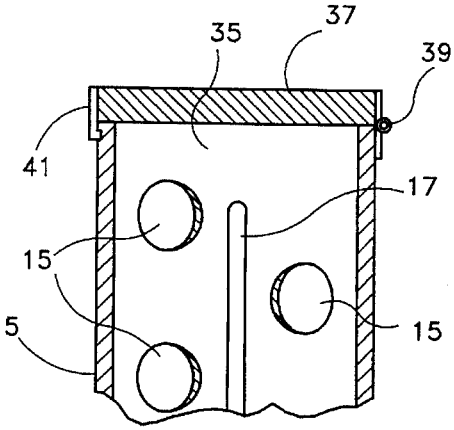

In addition to being straight and cylindrical, it is preferred that tube 3 be of a length sufficient to hold a plurality of balls in storage therein. Specifically, it is considered that tube 3 will be between three and five feet in overall length and made of lightweight metal or plastic. As shown in FIG. 6, tube wall 5 may contain one or more openings or fenestrations 15 through which the user may observe the number of balls stored in vertical alignment therein. Still further, as shown in FIG. 6, tube wall 5 may have formed therein an elongated slot 17 to aid the user in visualizing the number of balls stored therein. In another embodiment, tube wall 5 may contain or be made of translucent or transparent material, such as polyvinyl chloride to allow visualization of the balls in storage without having openings formed in the walls.

A circumferential groove 19 is formed concentrically in lower distal opened end 7, opening into the interior of hollow tube 3, and is defined by lower and upper, spaced-apart groove side surfaces 21 and 23, respectively, and a groove-base surface 25 passing between the lowermost depths of side surfaces 21 and 23.

Figure 5:
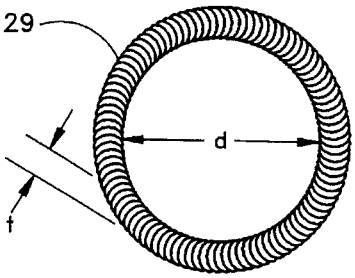
FIG. 5 is an illustrative view of the preferred embodiment of the ring of this invention; and, FIG. 6 is an illustrative view of the upper portion and upper end of the device of this invention showing other embodiments that may be utilized in combination with this invention.

A yieldable ring 27, preferably formed of an endless coil, smooth and shiny surfaced, metal spring 29, of thickness "t" (see FIG. 5) is concentrically located and loosely positioned in groove 19. Ring 27 is designed to have an internal diameter "d" slightly smaller than the outside diameter of the ball to be retrieved by device 1. A smooth, shiny surfaced metal coil spring 29 is preferred to provide the lowest frictional contact with the surface of the ball to be retrieved.

Figure 3:
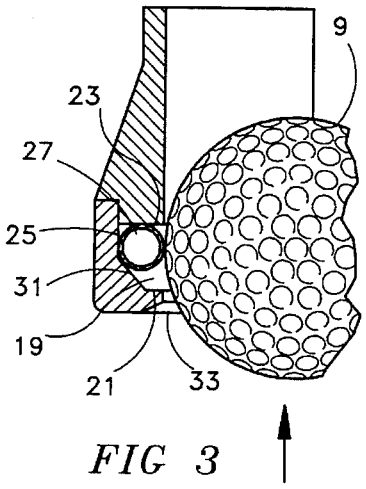
FIG. 3 is the same view as in FIG. 2 of the action of the ring of the invention in position to allow entry of a ball into the opened end of the device.

Groove 19 is arranged or designed to be wider than said thickness "t" of ring 27 so that ring 27 is moveable from side-to-side (i.e., upward and downward) therein and can be displaced upward therein, as shown in FIG. 3, in response to the upward pressure of a to-be-retrieved ball 9, when lower distal opened end 7 of tube 3 is positioned over the ball and pressed downward thereagainst. During this upward displacement, ring 27 is moved upward by ball 9, toward upper groove side surface 23, to the area of groove 19 having the largest diameter or, in other words, the deepest base surface 25. In this position, as shown in FIG. 3, there is sufficient depth to groove 19 to allow spring 29 to expand sufficient to allow passage of ball 9 through inside diameter "d" and thence into the upper portion of tube 3.

Figure 4:
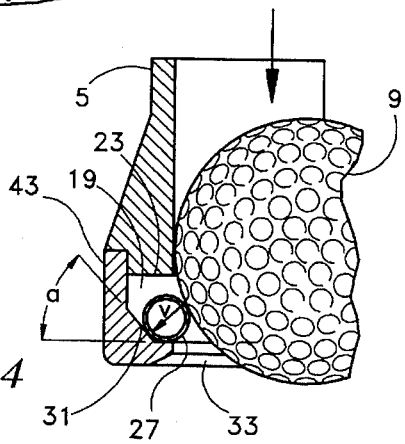
FIG. 4 is the same view as in FIG. 2 of the action of the ring in position to prevent retractive passage of the ball through the open end of the device.

Upon passage into tube 3 of a ball, the weight of the ball plus the gravitational pull on ring 27 causes it to be displaced downward in repose against lower groove side surface 21 where the diameter of groove 19 is the least or, in other words, where groove base surface 25 is the shallowest. In this position, and as shown in FIG. 4, the downward pressure of ball 9 develops a thrust vector "v" in ring 27 that travels across the maximum diameter of ring 27 and against the shallower base surface 25.

To aid in diffusing the downward thrust against ring 27, and centering of ring 27 in groove 19, groove 19 is further defined by an upwardly and outwardly slanted, base-surface portion 31 that preferably begins at lower side surface 21 and progresses upward and outward toward upper groove side surface 23 and terminates between said side surfaces 21 and 23 preferably before or short of upper groove surface 23. As shown in FIG. 4, the angle "a" of said slanted, base-surface portion 31 is of a magnitude or size to direct force vector "v" perpendicularly or normal to slanted base-portion 31 to provide maximum diffusing of the downward pressure into tube wall 3 and, simultaneously, preventing any retractive movement of ball 9 past ring 27. This insures that there will be no scuffing or other surface damage committed by ring 27.

Figure 2:
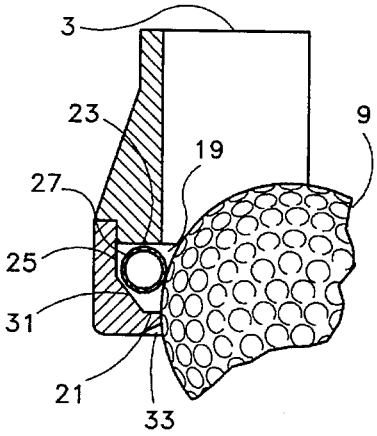
FIG. 2 is a sectional side view of a portion of the separate ball retrieving element located and attached to the open end of the ball retrieving tube in position over a to-be-retrieved ball, taken along lines 2—2 in FIG. 1.

As shown in FIG. 2, a centrally located, inverted, funnel-tapered surface 33 is formed on the underside of lower distal opened tube end 7 to aid in centering a to-be-retrieved ball concentric with ring 27.

Optionally, as shown in FIG. 6, the opposite or upper distal end 35 of tube 3 may be covered over by a lid 37 that is pivotally connected thereto by a hinge 39 and held in closed configuration over the opened end of said tube by a clasp 41. This openable end 35 of tube 3 is therefore adapted to discharge the balls stored in tube 3 when lid 37 is opened and tube 3 is inverted.

For ease in manufacture, simplicity of design and lower cost of assembly, it is preferred that groove 19 is formed in a separate element 43, as shown in FIGS. 1 and 4, and said element attached to lower distal tube end 7 by known manufacturing techniques.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the way to achieve substantially the same result are within the scope of this invention.

What is claimed is:

1. A ball retrieving and storage device comprising:

a) an elongated hollow tube opened at one end for reception of a ball;

b) said tube having formed in said opened end a circumferential groove concentrically arranged therewith opening inwardly toward the hollow interior of said tube and defined by upper and lower groove side surfaces;

c) a yieldable ring of measured thickness concentrically located in said groove, said ring having an internal diameter slightly smaller than the outside diameter of the ball to be retrieved;

d) wherein said groove is wider than the thickness of said ring to allow said ring to be moveable therein and displacable upward therein in response to the upward pressure of a to-be-retrieved ball from below when said opened end of said tube is passed over the ball; and, e) wherein said groove has a first depth, in the area of natural repose of the ring, and a second depth in the area of said upward displacement thereof, wherein said second depth is greater than said first depth to allow said ring to expand under said upward pressure of the ball and allow passage of the ball therethrough into storage in said tube and to prevent said ring from thereafter expanding under downward pressure of the ball and bar retractive passage of the ball out through said tube opened end.

2. The ball retrieving and storage device of claim 1 wherein said groove is further defined by a groove-base surface passing between said groove side surfaces wherein said base surface includes an upwardly and outwardly slanted portion.

3. The ball retrieving and storage device of claim 2 wherein one end of said slanted portion terminates at said lower groove side surface.

4. The ball retrieving and storage device of claim 2 wherein one end of said slanted portion terminates between said groove side surfaces.

5. The ball retrieving and storage device of claim 2 wherein one end of said slanted portion terminates below said upper groove side surface.

6. The ball retrieving and storage device of claim 2 wherein the angle of slant of said slanted portion of said groove base surface is of a magnitude as to direct a portion of any downward pressure on said ring outward against said tube.

7. The ball retrieving and storage device of claim 1 further including a reverse funnel-tapered surface disposed at said opened end of said tube, below said groove, to aid in centering a to-be-retrieved ball concentric with said ring.

8. The ball retrieving and storage device of claim 1 wherein said ring is an endless coil spring having a smooth, shiny surface.

9. The ball retrieving and storage device of claim 1 further including a second, openable end in said tube forming a dispensing opening adapted to discharge stored balls when said tube is inverted.

10. The ball retrieving and storage device of claim 1 wherein said tube has an inside diameter slightly greater than the outside diameter of the balls to be retrieved and stored therein.

11. The ball retrieving and storage device of claim 1 wherein said tube contains a translucent wall portion for providing visual indication of the number of balls stored therein.

12. The ball retrieving and storage device of claim 1 wherein said tube has formed therein an elongated slot for providing visual indication of the number of balls stored therein.

13. The ball retrieving and storage device of claim 1 wherein said groove is formed in a separate element that is attached to said opened end of said tube.

14. The ball retrieving and storage device of claim 1 wherein said tube is a straight tube.

15. A ball retrieving and storage device comprising:

a) an elongated hollow tube open at one end for reception of a ball therethrough;

b) said tube having formed in said opened end a circumferential groove concentrically arranged therewith opening inwardly toward the hollow interior of said tube and defined by upper and lower groove side surfaces and further defined by a groove-base surface passing between said groove side surfaces wherein said base surface includes an upwardly and outwardly slanted portion;

c) a yieldable ring of measured thickness concentrically located in said groove, said ring having an internal diameter slightly smaller than the outside diameter of the ball to be retrieved;

d) wherein said groove is wider than the thickness of said ring to allow said ring to be moveable therein and displacable upward therein in response to the upward pressure of a to-be-retrieved ball from below when said opened end of said tube is passed over the ball;

e) wherein said groove has a first depth, in the area of natural repose of the ring, and a second depth in the area of said upward displacement thereof, wherein said second depth is greater than said first depth to allow said ring to expand under said upward pressure of the ball and allow passage of the ball therethrough into storage in said tube and to prevent said ring from thereafter expanding under downward pressure of the ball and bar retractive passage of the ball out through said tube opened end; and, f) further including a reverse funnel-tapered surface disposed at said opened end of said tube, below said groove, to aid in centering a to-be-retrieved ball concentric with said ring.

16. The ball retrieving and storage device of claim 15 wherein one end of said slanted portion terminates at said lower groove side surface.

17. The ball retrieving and storage device of claim 16 wherein one end of said slanted portion terminates between said groove side surfaces.

18. The ball retrieving and storage device of claim 16 wherein one end of said slanted portion terminates below said upper groove side surface.

19. The ball retrieving and storage device of claim 16 wherein the angle of slant of said slanted portion of said groove base surface is of a magnitude as to direct a portion of any downward pressure on said ring outward against said tube.

20. The ball retrieving and storage device of claim 15 further including a reverse funnel-tapered surface disposed at said opened end of said tube, below said groove, to aid in centering a to-be-retrieved ball concentric with said ring.

* * * * *